United States Patent [19]

Martin

[11] 4,444,604

[45] Apr. 24, 1984

[54] METHOD OF PREVENTING DISTORTION OF A HEATED WORKPIECE DURING COOLING

[75] Inventor: Wayne A. Martin, Pittsburgh, Pa.

[73] Assignee: United States Steel Corporation, Pittsburgh, Pa.

[21] Appl. No.: 472,703

[22] Filed: Mar. 7, 1983

[51] Int. Cl.[3] ..... C21D 9/08

[52] U.S. Cl. ..... 148/131; 266/117; 269/48.1

[58] Field of Search ..... 148/131, 153; 269/48.1; 266/117, 119

[56] References Cited

U.S. PATENT DOCUMENTS

| | | | |
|---|---|---|---|
| 3,649,036 | 3/1972 | Harz | 269/48.1 |
| 3,932,238 | 1/1976 | Safford | 148/153 |
| 4,240,616 | 12/1980 | Takahashi et al. | 266/119 |
| 4,387,845 | 6/1983 | Mefferd | 269/48.1 |

FOREIGN PATENT DOCUMENTS

| | | | |
|---|---|---|---|
| 2806008 | 8/1979 | Fed. Rep. of Germany | 148/131 |

*Primary Examiner*—Peter K. Skiff

*Attorney, Agent, or Firm*—William F. Riesmeyer, III

[57] ABSTRACT

A method is provided for preventing distortion of a heated cylindrical metal workpiece during cooling. The method includes heating the workpiece and then placing a fixture substantially at room temperature in the workpiece. The fixture has a plurality of axially-spaced holder plates with shoe members slidably mounted at spaced locations on the plates. A plurality of tapered pin assemblies are used to secure each shoe member in fixed position initially so as to define the desired cold shape of the workpiece. The workpiece is then cooled with the fixture in place. After cooling of the workpiece, the tapered pin assemblies are partially withdrawn from tapered holes in the shoe members and holder plates so as to permit removal of the fixture from the workpiece.

6 Claims, 9 Drawing Figures

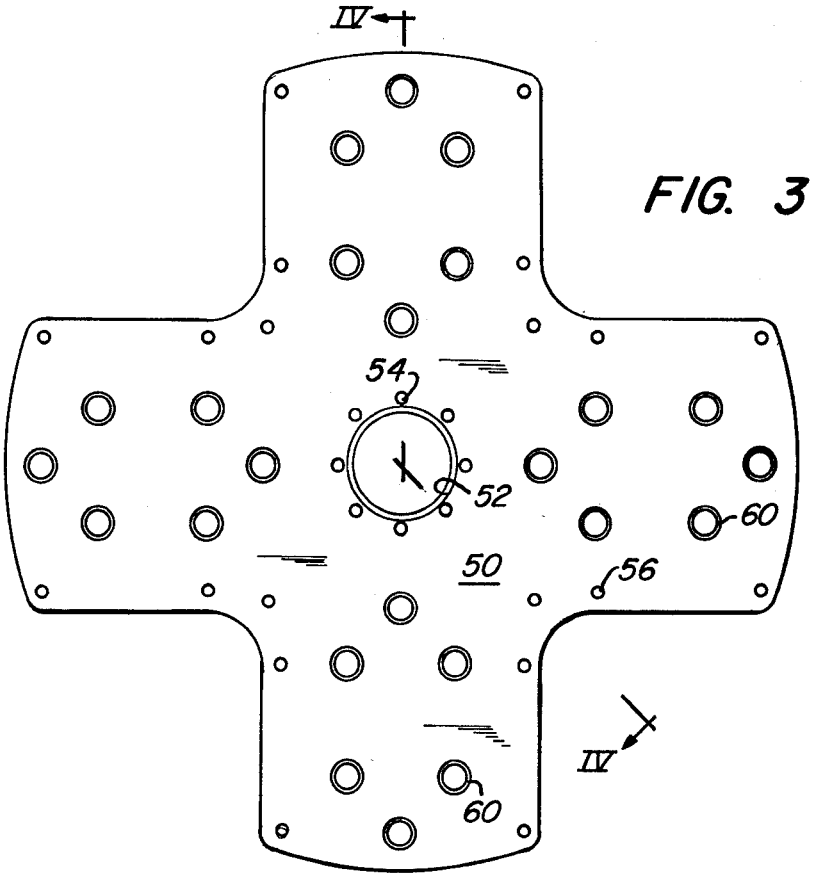
FIG. 3
FIG. 4
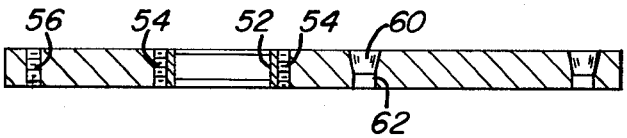
FIG. 5
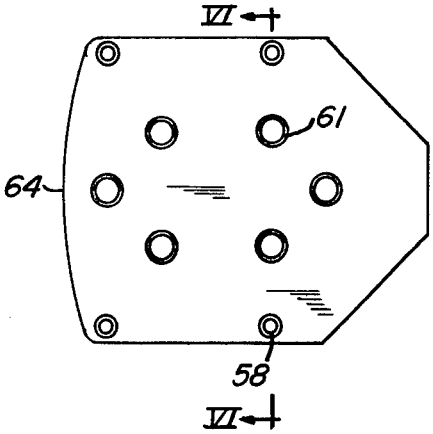
FIG. 6
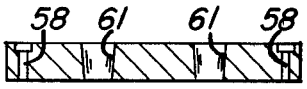
FIG. 7
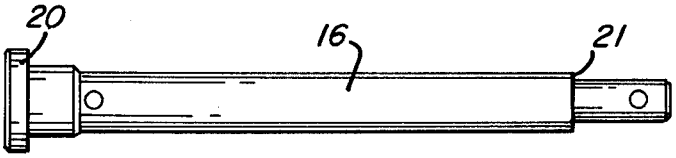

METHOD OF PREVENTING DISTORTION OF A HEATED WORKPIECE DURING COOLING

BACKGROUND OF THE INVENTION

The present invention relates to a method of preventing distortion during cooling of a heated workpiece having a cavity therein.

During the next decade it is expected that a significant market will exist for very large cylindrical forgings used in coal gasification reactors and liquefaction pressure vessels. These vessels are of very large diameter and length requiring a series of the cylinders to be welded or otherwise fastened in end-to-end relationship. The cylinders have an internal diameter and length both of about twelve-feet (12') in each direction, and wall thickness of about eight-inches (8") or thicker. After forging, the normal procedure is to rough machine the inside and outside surfaces of the cylinder, austenitize, quench and temper, and then machine all over to final size. It will be apparent that the dimensional and concentricity specification tolerance must be close in view of the subsequent end-to-end welding operation for construction of the vessels. Significant savings could be realized if it were possible to eliminate the final machining operation. This may be possible if distortion during the tempering operation could be prevented. Elimination of the final machining operation would enable the manufacturer to leave far less stock on the forged product resulting in a significant increase in yield, as well as a greater production rate for a given number of large turning machines.

In the past a large single circular-shaped plate has been used for insertion into the cavity of a heated forging for preventing distortion of the forging during cooling. This practice has been used on forgings in which it was only necessary to control distortion at a recess groove located approximately ten-inches (10") from the bottom face of the forging. It was not necessary to control distortion over the full length of the total cavity in these forgings because of their greater wall thickness and shorter height than the cylinders to which the method of the present invention is directed. Prior to insertion, the plate was carefully machined to a diameter at or only very slightly less than the desired cold size of the cavity in the forging. Upon cooling, the forging contracts and may place the plate in compression to some degree. Removal of the plate sometimes is very difficult causing it to become bent and rendering it unsuitable for further use.

Expandable arbor devices are known for various purposes on relatively small size workpieces. For example, U.S. Pat. No. 2,616,462, Haddican, U.S. Pat. No. 3,742,186, Finkel et al, and U.S. Pat. No. 3,792,856, Hernandez illustrate this type of apparatus. However, none of the references expressly or impliedly suggest that the devices shown therein may be used for preventing distortion of very large cylinders during cooling. Moreover, the devices are not suitable for such use since setting the arbor at an initial expanded position of precise dimension is not possible with the configurations shown.

It is therefore a primary object of the present invention to provide a method of preventing distortion of large workpieces during cooling which overcomes the above-mentioned problems and disadvantages of the prior method.

SUMMARY OF THE INVENTION

According to the present invention a method is provided for preventing distortion of a cylindrical metal workpiece during heat treatment. The method includes heating the workpiece to an elevated temperature, preferably to a temperature of at least about 1000° F. After heating the workpiece, a fixture which is substantially at room temperature, is placed in the workpiece. The fixture has a plurality of axially-spaced holder plates aligned transverse to the axis of the workpiece and means connecting the holder plates for fixing the spacing therebetween. Each holder plate has a plurality of shoe members slidably mounted on them. The shoe members are positioned so as to abut a wall of the workpiece at spaced locations on the inner periphery thereof. Each of the shoe members is secured to the holder plates in a fixed initial position by a plurality of tapered pin assemblies engaged in mateable tapered holes in the shoe members and holder plates. Thus, the shoe members define the desired cold shape of the workpiece. The workpiece is then cooled with the fixture in place therein. After cooling of the workpiece, the tapered pin assemblies are partially withdrawn from the holes so as to permit slidable movement of the shoe members in a radially inward direction on the surface of the holder plates as needed to relieve pressure of the workpiece on the shoe members. Finally, the fixture is withdrawn from the workpiece and may be used over and over again. It is preferable that the holder plates be of cruciform-shape and have openings of sufficient size adjacent the inner wall surface of the workpiece so as to substantially prevent a temperature differential from occurring between the inner and outer surfaces of the workpiece during cooling. This may best be prevented by using a fixture having the aforementioned holder plates and flowing cooling gas or air along the inner and outer surfaces of the workpiece during the cooling step.

BRIEF DESCRIPTION OF THE DRAWINGS

FIG. 3 is a plan view of one of the holder plates of the fixture.

FIG. 4 is a section taken at IV—IV of FIG. 3.

FIG. 5 is a plan view of one of the shoe members attached to the holder plates.

FIG. 6 is a section taken at VI—VI of FIG. 5.

FIG. 7 is a side elevation view of the centering bar part of the apparatus used in the method of this invention.

DESCRIPTION OF THE PREFERRED EMBODIMENT

Figure 1:
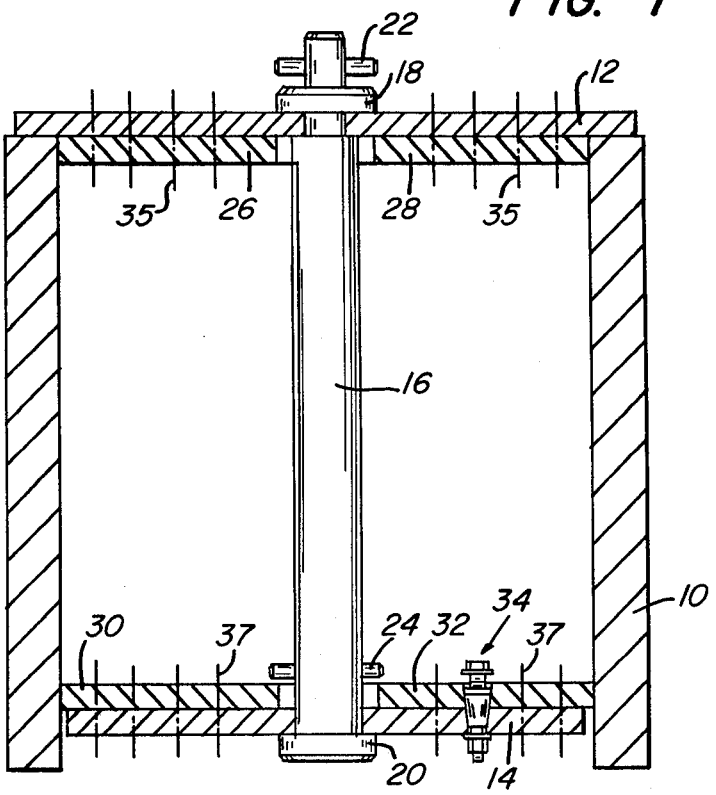
FIG. 1 is a longitudinal cross-section showing the fixture used in the method of the present invention.
Figure 8:
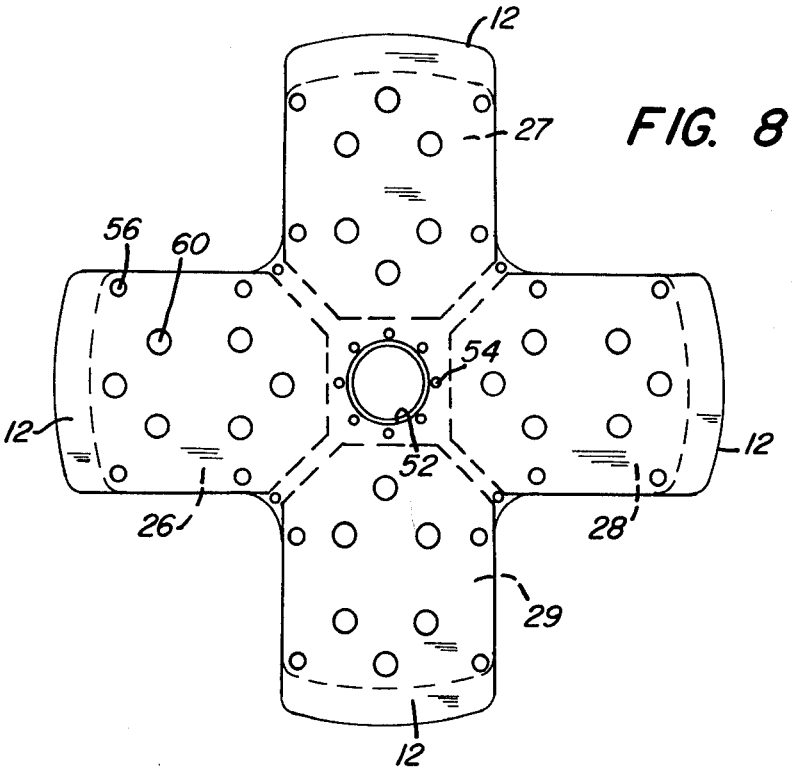
FIG. 8 is a plan view of the top holder plate of FIG. 1 showing the shoe members in position thereon.
Figure 9:
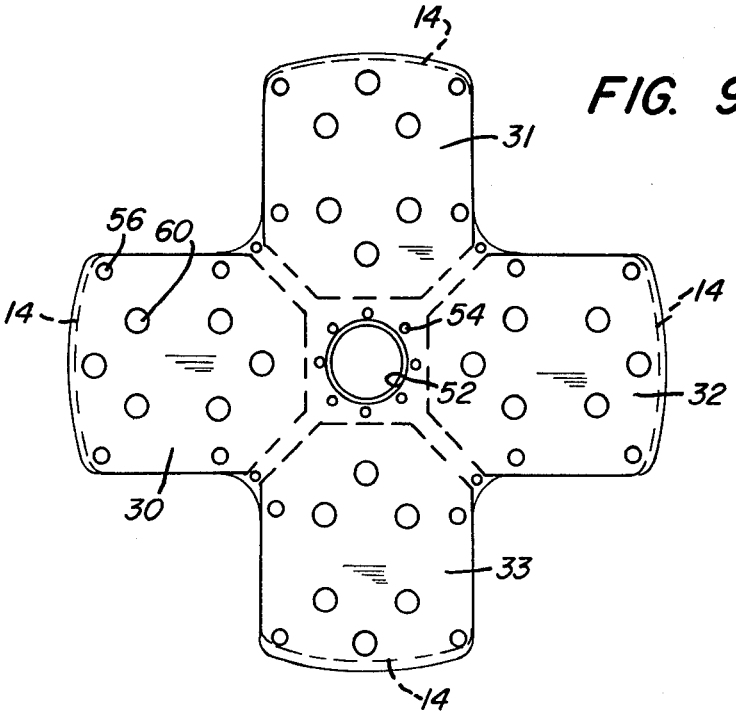
FIG. 9 is a plan view of the bottom holder plate of FIG. 1 showing the shoe members in position thereon.

The method of the present invention is especially applicable to a tempering treatment of large steel cylinders for coal gasification reactors and liquefaction pressure vessels. Prior to this invention the cylinders were forged, normalized, and preliminarily machined all over. They were then austenitized, quenched and tempered. After tempering, the cylinders were again machined all over to final dimensions. When the present invention is used the cylinders are forged, normalized, and then machined all over, with the inner and outer diameters being machined to final dimensions. Then the cylinders are austenitized, quenched and tempered, with the method of this invention being used during the tempering treatment. After tempering, using the method of this invention, it is only necessary to part the test ring off of one end of the cylinder and face the ends to final dimensions. When the cylinder has been held for sufficient time of treatment at the tempering temperature, the furnace is opened and a fixture is placed in the cylinder. FIG. 1 shows a large forged and machined steel cylinder 10 in longitudinal cross-section. The fixture includes a pair of holder plates 12, 14 and a centering bar 16 for fixing the holder plates at axially-spaced locations in the cylinder. The centering bar has flange collars 18, 20 secured to the holder plates by bolts or studs (not shown). A pin 22 serves as a lift bar which may be engaged by a chain or other means for transport of the fixture. Pin 24 serves as a safety restraint for the bottom holder plate so as to prevent it from tipping and falling during transport. Four shoe members 26, 27, 28 and 29 are fastened to the top holder plate 12 (FIG. 8) by a plurality of tapered pin assemblies located at positions indicated by centerlines 35 (FIG. 1). Similarly, four shoe members 30, 31, 32 and 33 are fastened to the bottom holder plate 14 (FIG. 9). The shoe members are fastened to the bottom holder plate by a plurality of tapered pin assemblies, one of which is illustrated at 34 (FIG. 1) and is shown in an enlarged view in FIG. 2. Other pin assemblies of the exact same type are located at positions 37 (FIG. 1). Each pin has a tapered body portion 39 and threaded stems 36, 38 extending from opposite ends of the body. Nuts 40, 42 are mounted on the stems along with washers 41, 43.

FIGS. 3 and 4 show more details of one of the holder plates. Each plate has a body portion 50 and a central bore 52 in the body for receipt of the centering bar therethrough. A plurality of tapped holes 54 are provided spaced around the bore 52 to receive cap screws for securing the holder plate to one of the collars 20, 21 on the centering bar (FIG. 7). Additional tapped holes 56 are provided for a purpose to be described hereafter. Finally, the holder plate has a plurality of tapered holes 60 for receiving the tapered pin assemblies 34 as illustrated in FIG. 1. The holes 60 have a taper of 3° which stops just short of the base of the holes where they join a straight portion 62. FIGS. 5 and 6 show the details of one of the shoe members. Each shoe member has a plurality of tapered holes 60 mateably aligned with the holes 60 in the holder plate for receipt of the tapered pin assemblies. Counterbored holes 58 in the shoe members are mateably aligned with the holes 56 in the holder plate for a purpose to be described.

Figure 2:
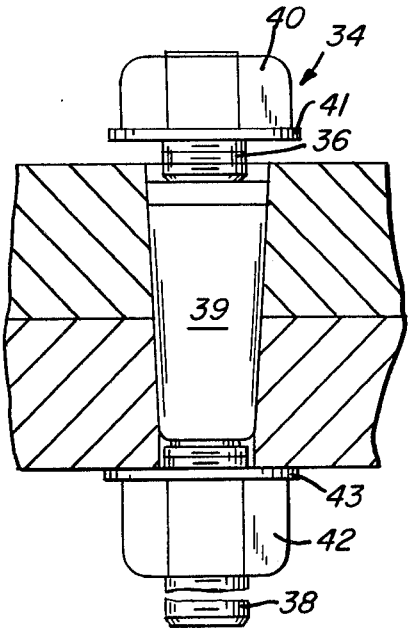
FIG. 2 is an enlarged view of the threaded tapered pin and nut assemblies for attaching the shoe members to the holder plates of the fixture.

The shoe members are initially fixed in proper position on the holder plates for defining the cold shape and dimensions of the cylinder. This is accomplished by tightening the nut 42 of each pin assembly as shown in FIG. 2. The fixture is placed in position in the cylinder, as previously mentioned, when the cylinder is at tempering temperature. In our car-bottom furnaces, the car is moved out of the furnace to permit placing the fixture in the cylinder. The car is then moved back into the furnace and heated until it recovers to the tempering temperature. The cylinder is then cooled with the fixture therein. After cooling, the tapered pin assemblies are partially withdrawn from the holes in the shoe members first by loosening nut 42 and then tightening nut 40 of each pin assembly. Then the fixture is withdrawn from the cylinder.

It will be apparent that the fixture must be made to very close dimensional tolerances in order to accomplish its intended purpose. The desired tolerances may best be obtained by the following method: First, the holder plates are cut to proper shape and size. Holes 56 are drilled and tapped at the locations indicated in FIG. 3. Then four shoe members are cut to slightly larger than final size and drilled to provide counterbored holes 58 (FIG. 5). The shoe members are then secured by bolts (not shown) inserted in the mateable holes 56, 58 to the holder plate. Straight holes 62 are drilled through the shoe members and holder plate at the various desired location. Each hole is then reamed so as to provide the taper 61 in the shoe members and the taper 60 in the holder plate, stopping just short of the base of the hole in the plate. The assembled holder plate and shoes are then mounted in a vertical boring mill and the end faces 64 of each shoe machined so that the shoe members define the desired cold shape and size of the cylinder to very close tolerances.

I claim:

1. A method for preventing distortion of a cylindrical metal workpiece during heat treatment, said method comprising:

(a) heating said workpiece to an elevated temperature, (b) placing a fixture substantially at room temperature into the heated workpiece, said fixture having a plurality of axially spaced holder plates, means connecting said holder plates fixing the spacing therebetween, a plurality of shoe members slidably mounted on each holder plate for abutting a wall of the workpiece at spaced locations on the inner periphery thereof, and a plurality of tapered pin assemblies located in mateable tapered holes in said shoe members and holder plates for securing said shoe members to a fixed initial position so that outer peripheries of the shoe members define the desired cold shape of said workpiece, (c) cooling said workpiece with the fixture in place therein, (d) partially withdrawing said tapered pin assemblies from said holes after cooling the workpiece so as to permit slidable movement of the shoe members in a radially inward direction on the holder plates, and then (e) removing said fixture from the workpiece.

2. The method of claim 1 wherein said heating step includes heating said workpiece to a temperature of at least 1000° F.

3. The method of claim 1 further comprising machining the inner and outer surfaces of said workpiece to final size prior to the step of heating said workpiece.

4. The method of claim 2 further comprising machining the inner and outer surfaces of said workpiece to final size prior to the step of heating said workpiece.

5. The method of claim 1 wherein step (b) includes placing a fixture having holder plates of cruciform-shape in the workpiece, said holder plates having openings of sufficient size adjacent the inner wall of the workpiece to substantially prevent a temperature differential from occurring between the inner and outer surfaces of the workpiece.

6. The method of claim 5 wherein step (c) includes flowing cooling gas along the inner and outer surfaces of said workpiece.

* * * * *